United States Patent [19]

Fox

[11] 4,377,080

[45] Mar. 22, 1983

[54] APPARATUS FOR OBTAINING VARIEGATED PATTERNS

[75] Inventor: Gary R. Fox, Dalton, Ga.

[73] Assignee: Greenwood Corp. of America, Dalton, Ga.

[21] Appl. No.: 295,818

[22] Filed: Aug. 24, 1981

Related U.S. Application Data

[63] Continuation-in-part of Ser. No. 179,752, Aug. 20, 1980, abandoned.

[51] Int. Cl.[3] ..... D06B 1/06

[52] U.S. Cl. ..... 68/205 R; 137/561 A; 137/883; 239/553.3

[58] Field of Search ..... 68/200, 205 R; 118/324, 118/325; 239/553, 553.3; 137/561 A, 883

[56] References Cited

U.S. PATENT DOCUMENTS

| | | | |
|---|---|---|---|
| 596,905 | 1/1898 | McCoy . | |
| 1,948,568 | 4/1930 | Faber et al. | 68/5 C X |
| 1,964,257 | 6/1934 | Gilmore . | |
| 2,218,811 | 10/1940 | Chausabel | 68/205 R X |
| 2,537,290 | 1/1951 | Williams et al. | 68/200 X |
| 2,680,079 | 6/1954 | Heubner . | |
| 2,697,637 | 12/1954 | Mittelstadt | 239/553.3 |
| 3,127,014 | 11/1964 | Miller et al. | 68/205 R X |
| 3,155,540 | 11/1964 | Loeffler et al. | 118/60 |
| 3,256,581 | 6/1966 | Thal et al. | 26/2 R |
| 3,431,889 | 3/1969 | Fraatz | 118/315 |
| 3,452,710 | 7/1969 | Hentschel | 118/324 X |
| 3,660,994 | 5/1972 | Gowin | 68/205 R |
| 3,667,258 | 6/1972 | Newton | 68/205 R |
| 3,683,649 | 8/1972 | Takriti et al. | 68/205 R X |
| 3,688,530 | 9/1972 | Harris et al. | 68/205 R |
| 3,694,142 | 9/1972 | Schniorer | 8/151 |
| 3,717,722 | 2/1973 | Messner | 118/624 X |
| 4,010,709 | 3/1977 | Sayman et al. | 68/205 R X |
| 4,023,526 | 5/1977 | Ashmus et al. | 118/410 |
| 4,099,913 | 7/1978 | Walter et al. | 8/173 |
| 4,108,595 | 8/1978 | Pappas | 8/149 X |
| 4,118,526 | 10/1978 | Gregorian et al. | 427/350 |
| 4,141,231 | 2/1979 | Kudlich | 68/205 R |
| 4,170,883 | 10/1979 | Varner | 68/205 R |
| 4,170,958 | 10/1979 | Moser | 118/325 |
| 4,193,762 | 3/1980 | Namboodri | 68/200 X |
| 4,208,173 | 6/1980 | Gregorian et al. | 8/477 X |
| 4,254,644 | 3/1981 | Bartlett et al. | 68/205 R |
| 4,277,960 | 7/1981 | McKendrick et al. | 68/205 R |

FOREIGN PATENT DOCUMENTS

| | | | |
|---|---|---|---|
| 47495/79 | 6/1979 | Australia . | |
| 1288681 | 9/1972 | United Kingdom | 68/205 R |
| 1296725 | 11/1972 | United Kingdom | 68/205 R |
| 2022017 | 12/1979 | United Kingdom | 68/205 R |

*Primary Examiner*—Philip R. Coe
*Attorney, Agent, or Firm*—Sherman & Shalloway

[57] ABSTRACT

The present invention comprises the variegated patterning of fabrics by passing the fabric adjacent an applicator edge, forming a continuous sheet of a first coating of sufficiently low viscosity to penetrate the fabric, delivering discrete units of a second coating being of a viscosity sufficiently low to penetrate the fabric, permitting said first and second coatings to interdisperse and delivering the interdispersed coatings to the applicator edge, and applying the coating to the fabric as a continuous sheet flowing from the applicator edge directly onto the surface of the passing fabric, and the apparatus therefor.

8 Claims, 9 Drawing Figures

46
53
52
51
50
6
22
56
19
19
19
54
24
34
21
4
4
29
38
24
7
68
54
30
31
24
33
34
20
32
20
4
55
6
2
44
71
12

APPARATUS FOR OBTAINING VARIEGATED PATTERNS

CROSS REFERENCE OF RELATED APPLICATION

This is a continuation-in-part of U.S. patent application Ser. No. 179,752, filed Aug. 20, 1980, now abandoned, and is copending with patent application Ser. No. 227,939 filed Jan. 23, 1981.

BACKGROUND OF THE INVENTION

The present invention relates to the patterning of dye penetrable fabrics and is concerned, more particularly, with the achievement of diffuse, variegated patterning of multiple colors and tones in regard to the surface area of the fabric and in regard to the length of the individual tufts, in the case of pile fabrics.

BRIEF DESCRIPTION OF THE PRIOR ART

The most relevant prior art known to me includes:

U.S. Pat. No. 596,905, which discloses a system for blending colors for application to wallpapers by means of a pickup roller and a corrugated delivery plate delivering the coloring matter onto the paper. This early system lacks sufficient control to achieve the variegation desired.

U.S. Pat. No. 1,964,257, which discloses a system for coloring film strips by the use of brushes or sprays which are applied directly onto the film and provide a longitudinal pattern instead of the variegation desired by the present invention.

U.S. Pat. No. 2,218,811, which discloses a form of dyeing system which employs multiple nozzles for dripping differing colors as discrete drops directly upon the surface of the fabric to be dyed, without the interdispersion of the dyes sought by the present invention.

U.S. Pat. No. 2,680,079, which discloses a system for coating sheet or web material using electromagnetic forces to control the deposition of the coating materials from heated plates onto the web.

U.S. Pat. No. 3,155,540, which discloses the use of reciprocating multiapertured extruders for applying stripes of differing coating material in straight or zigzag form directly onto the receiving fabric. A form of plenum chamber is shown serving an aperture chamber.

U.S. Pat. No. 3,256,581, which discloses the direct application of patterning material onto webs by means of nozzles which are reciprocated by templates to produce a finite pattern along the web.

U.S. Pat. No. 3,431,889, which discloses the use of spaced capillary nozzles for direct application of materials to webs without lateral ambulation or mingling of the droplets prior to their impingement upon the web so as to provide a precise pattern effect.

U.S. Pat. No. 3,452,710, which discloses an electronic control system for selectively opening or closing plural nozzles in a coating system in accordance with the rate of travel of metal sheets to provide uniform, adequate coating of lubricants or rust inhibitors.

U.S. Pat. No. 3,660,994, which discloses the use of a metering roll to govern the transfer of dyes via a spill plate to a moving web of material for uniform dyeing of the web.

U.S. Pat. No. 3,667,258, which discloses the use of a grooved or ribbed spill plate to deliver dyes to a web in a striped pattern.

U.S. Pat. No. 3,683,649, which discloses the use of a mechanical interference to disrupt streams of dye into discrete drops falling directly onto the web.

U.S. Pat. No. 3,962,142, which discloses the use of a reciprocating spill plate and a reciprocating wiper element for mechanical distribution of dyes on the plate. This does not achieve the interdispersion and variegation sought by the invention.

U.S. Pat. No. 3,717,722, which discloses the clear printing of webs by successive nozzle rows over the web with nozzle motion and pattern controls to produce a uniform appearance of the pattern regardless of the speed of the web.

U.S. Pat. No. 4,010,709, which discloses the dyeing of webs of material by the application of a viscous precoat; application of dyes to the upper surface of the precoat, and subsequent release of the composite coating by heating to thin the coating to sink through the pile to the backing layer. This relies on the occurence of local pools or puddles of dye upon the surface of the precoat, without predispersion as sought by the present invention.

U.S. Pat. No. 4,141,231, which discloses the use of vacuum to position spray or drop-printed patterns in the depth of a stepwise coated web.

U.S. Pat. No. 4,170,883, which discloses a computer form of control for spray-printing of fabrics.

U.S. Pat. No. 4,170,958, which discloses the penumatic interruption and localizing of dye sheets into irregular drops or strings of dye prior to engagement of the dye with the web to which it is applied.

The prior art fails to supply a method or installation which is capable of producing prediffused, variagated patterns which may be controlled for general pattern reproducibility while avoiding distinct lineations between adjacent color areas. Accordingly, the prior art fails in regard to the following objects of the present invention and in regard to the unique advantages which are achieved by the method and apparatus of the invention.

SUMMARY OF THE INVENTION

It is an object of the present invention to provide diffuse variegated dye coatings on fabrics. It is another object of the present invention to provide variegated, interdiffused color patterns in dye penetrable fabrics. It is a further object of the present invention to provide variegated and interdispersed color patterns in pile fabrics by predispersion of multiple dyes as a continuous sheet of penetrating coating prior to the application thereof to the fabric. It is a further object of the present invention to provide for the variegated-pattern penetration of dyes into pile fabrics with improved distribution of the dyes along the length of the individual tufts of the pile. A further object of the invention is the provision of a system for producing variegated patterns on dye penetrable fabrics while requiring minimal alterations in existing dye lines. A further object of the invention is the provision of a system for producing variegated patterns in dye penetrable carpet fabrics with sufficient diffusion of the differing dye areas to prevent the clear or optically finite borders between adjacent colors which are typical of present systems. A further object of the invention is the provision of a system for producing variegated patterns in dye penetrable pile fabrics for use as carpeting in which the colors of the variegated pattern are not only interdiffused but also distributed more uniformly along the length of the individual tufts to reduce the visible consequences which otherwise follow from heavy wear in local areas when the pattern is not so improvedly applied along the tufts.

In general, the preferred method of the present invention comprises the variegated patterning of fabrics by passing the fabric adjacent an applicator edge, forming a continuous sheet of a first coating of sufficiently low viscosity to penetrate the fabric, delivering discrete units of a second coating into said continuous sheet of first coating, said second coating being of a viscosity sufficiently low to penetrate the fabric, permitting said first and second coatings to interdisperse and delivering the interdispersed coatings to the applicator edge, and applying the coatings to the fabric as a continuous sheet flowing from the applicator edge directly onto the surface of the passing fabric and the apparatus therefor.

In general, the preferred form of apparatus of the present invention comprises an applicator plate having an applicator edge positionable across the width of a moving length of fabric, the plate having a smooth upper surface inclined toward the applicator edge, means for delivering a first coating onto the upper plate surface to form a continuous sheet of the first coating flowing by gravity toward the applicator edge, means including plural nozzles positioned for delivery of a second coating material onto the sheet of first coating material upstream of the applicator edge, and control means for selectively delivering the second coating material through selected nozzles to interdisperse with the sheet of first coating material upon the upper plate surface.

The foregoing summary and the preceeding objects of the invention impart a general understanding of the nature and the purposes thereof.

BRIEF DESCRIPTION OF THE DRAWINGS

These and other objects of the invention, as well as better understanding thereof, may be derived from the following description and the accompanying drawings, in which.

DETAILED DESCRIPTION OF THE PREFERRED EMBODIMENT

Figure 1:
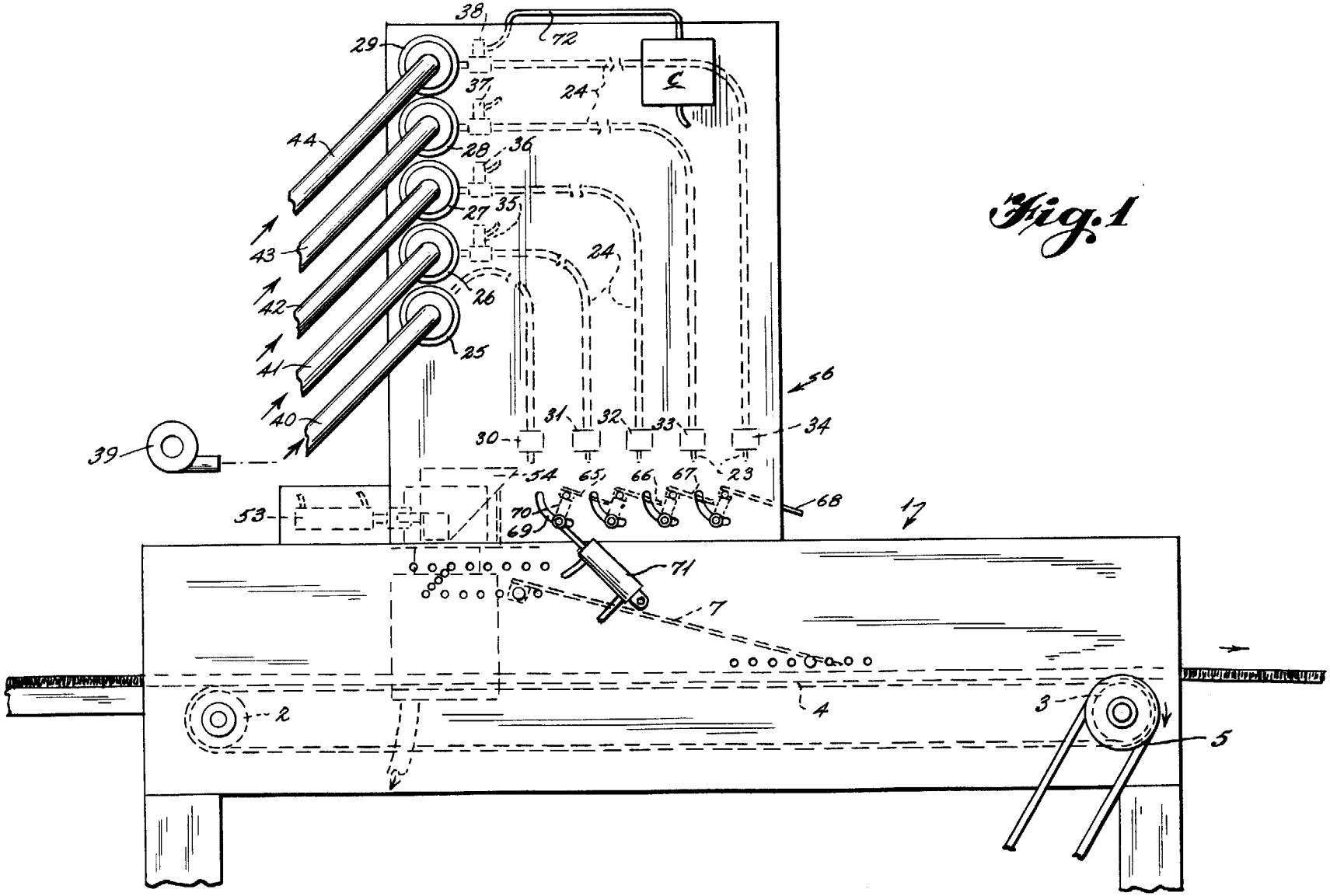
FIG. 1 is a side elevation of the preferred system of the invention installed on a conventional dye line.
Figure 2:
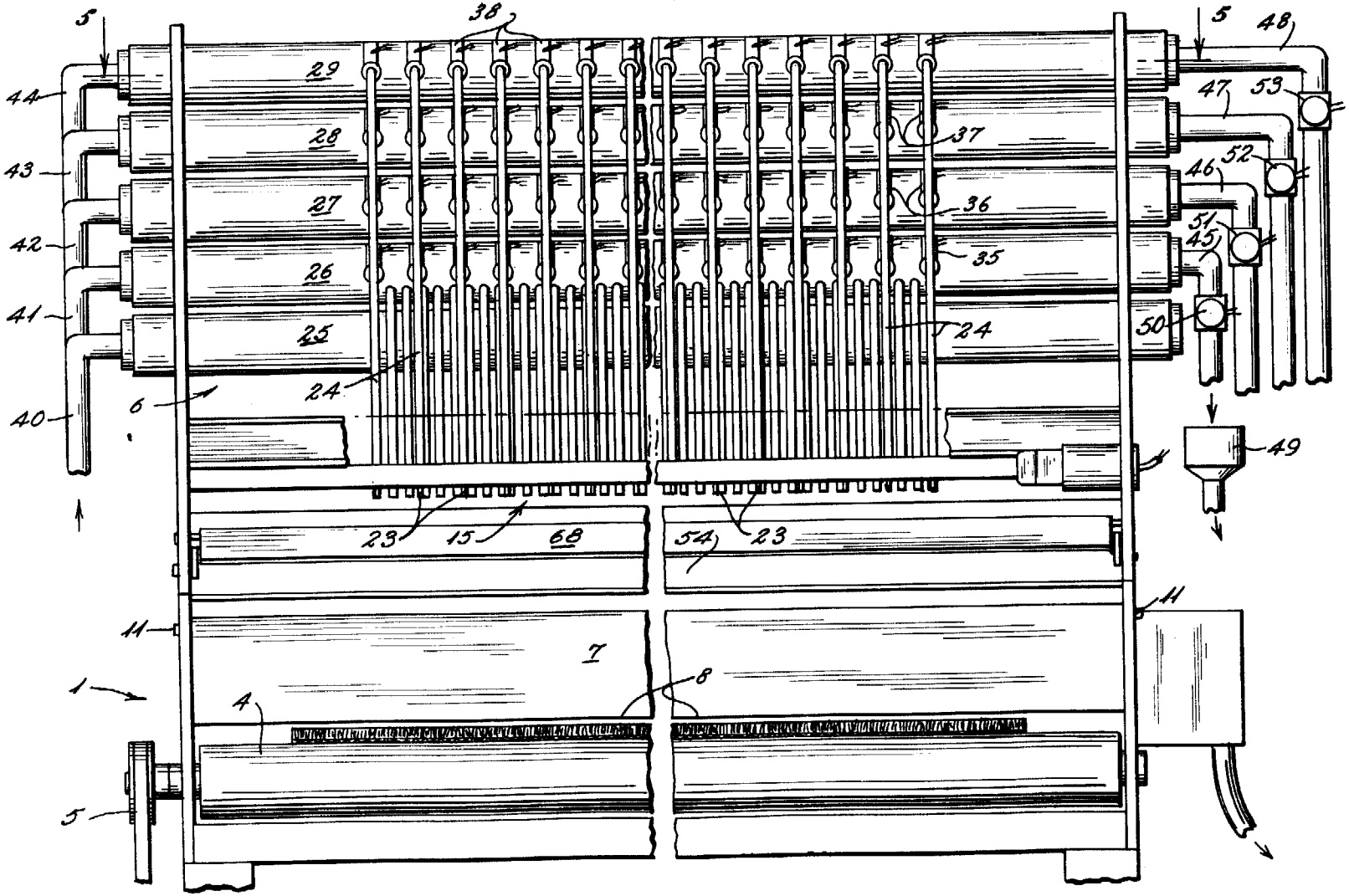
FIG. 2 is an end view of the installation and taken from the right hand side of FIG. 1.

As shown in the drawings, the preferred form of the invention is embodied in an installation for producing a dyed run of pile fabric for use as carpeting. It is to be understood, however, that other types of dye penetratable fabrics may be patterned by the method and apparatus of the invention where a diffused variegation of colors is desired. The present invention has been found to be effective on woven and knit fabrics as well as the pile fabric depicted in the drawings.

The preferred system of the present invention is installed on a conventional dye line 1 having rollers 2 and 3 and a supporting bed 4. Conventional means for advancing the fabric, such as a drive 5 for rotating the roller 3, may be utilized and the dye line may include other stations for treating the fabric, such as drying means.

A pattern former 6 is mounted above the bed 4 and includes an applicator plate 7 having a straight applicator edge 8 located in dye line 1 positioned closely adjacent the plane of the upper ends of the tufts in the pile fabric. The edge 8 is formed by relieving the lower corner 9 of the plate to produce a knife-like straightedge and is aligned substantially at a right angle with respect to the linear path of travel of the fabric F.

The plate 7 includes a flat and smooth upper surface 10 which slopes downwardly toward its edge 8 at an angle of from about 2° to about 30° with respect to the horizontal. The plate 7 also preferably is moveable to differing positions and angles for different dyes and fabrics, which may be effected by any desired means, such as the simple form of pins 11 and apertures 12 shown in the drawings, along with a saddle 13 on the rear edge of the plate 7. Angulation may be achieved via intermediate-height apertures 14, only one row of which are shown in order to avoid unnecessary clutter in the drawings.

Figure 3:
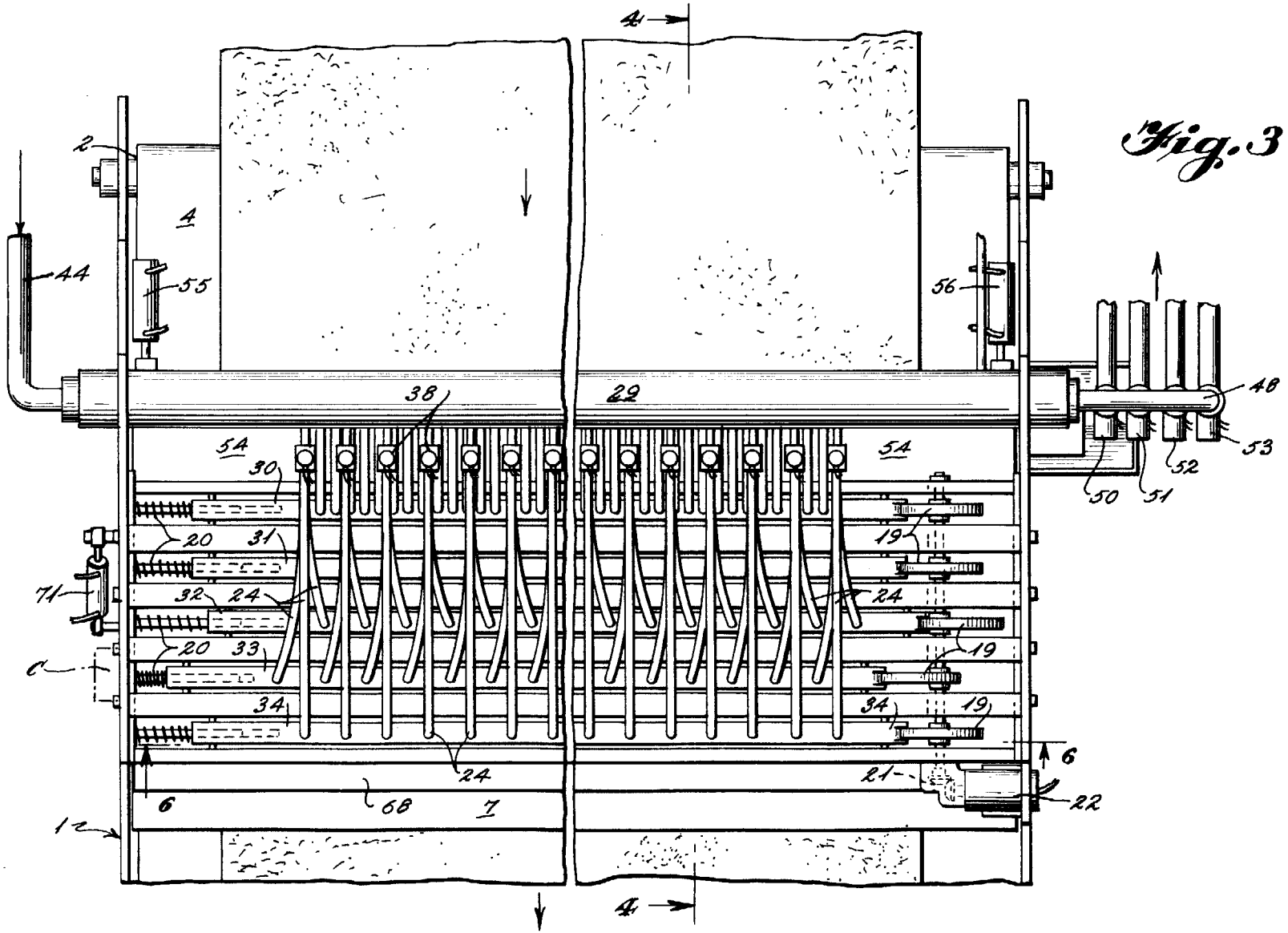
FIG. 3 is a plan view of the installation.
Figure 6:
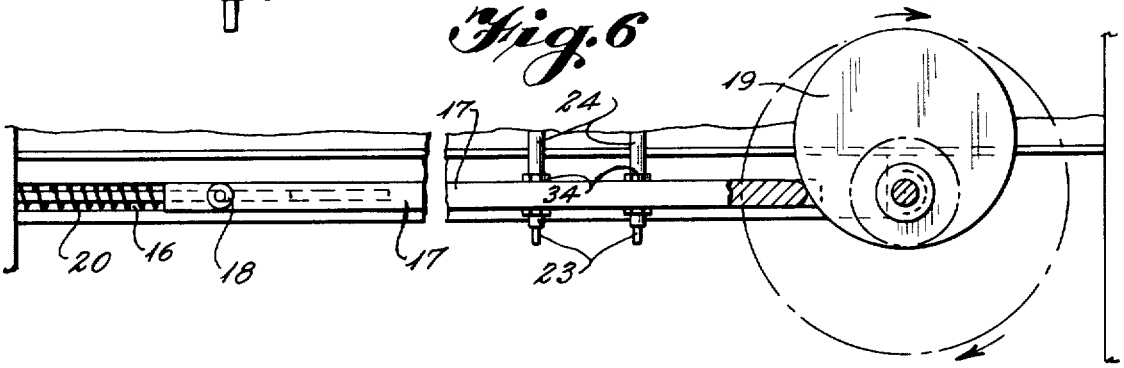
FIG. 6 is an enlarged section taken on the line 6—6 of FIG. 3 showing a drive for the reciprocating nozzle bars.

Superimposed above the plate 7 is a framework 15 mounting a plurality of transverse guide tracks 16 for reciprocating nozzle bars 17. The nozzle bars 17 preferably are mounted in the tracks 16 by means of rollers 18 and are driven by any suitable means such as the cam system shown, in FIG. 3 and FIG. 6, which includes a cam 19, return spring 20, gearing 21 and a motor 22 for each of the several nozzle bars so that they may be operated separately and selectively, as will be discussed more fully hereinafter. It should be noted that only one motor 22 is shown in the drawings, in the interest of clarity, and that the several nozzle bars are independently driven by a single motor; however, if desired, the several nozzle bars may be driven by a separate one of a plurality of such motors, utilizing individual motors for driving each of the nozzle bars.

Each nozzle bar carries a plurality of nozzles 23 along its length in an array of rows which is parallel to the applicator edge and the path of reciprocation of the bar so that the nozzles are moveable transversely of the path of travel of the fabric. The individual nozzles 23 each are served by a single flex tube 24 extended from one of several distributors 25, 26, 27, 28 and 29, which carry rows of delivery apertures 30, 31, 34, 33 and 34, respectively for communication with the flex tubes. The distributor head 25 carrying the coating material is supplied to nozzles 23' through flexible tube 24'. Distribution nozzle 23' is slightly larger than dye nozzle 23 in order to enable an even distribution of the coating material to the surface of plate 10 prior to the distribution of the dyestuff.

The flex tubes connected to the apertures of row 30 are directly connected thereto to provide for a constant flow of material therethrough during operation of the system. The apertures of rows 31 to 34 are individually controlled by a series of rows of electromagnetic valves 35, 36, 37 and 38, respectively. Typically, all the nozzles of a given nozzle bar are served from the same distributor. It is to be understood, however, that the flex tubes 24, which are preferably all of equal length and small internal diameter to provide uniform flow resistance to dyes passing therethrough and to prevent dripping at the nozzles, may be rearranged if desired.

The distributors conveniently are arranged in a vertical row and are individually served via a plurality of pumps, exemplified by the single pump 39 shown, via lines 40, 41, 42, 43 and 44, respectively. The distributors 26 through 29 also receive a series of individual recycle drain lines 45, 46, 47 and 48, respectively, serving a plurality of drains, such as the single drain 49 shown, which are connected to the intakes of their respective pumps by any suitable means. The recycle drain lines 45 through 48 include individual valves 50 through 53, respectively, for opening and closing the recycle path.

A cutoff drain 54 is mounted for reciprocation by any suitable means, such as the drive cylinders 55 and 56 shown, and includes a lip 57 which is positionable beneath the nozzle row adjacent the upper edge of the plate 7 to provide for recycle of flow of that row during periods when the system is stopped for repairs or servicing or when first coating step is not necessary or is desirable.

Figure 4:
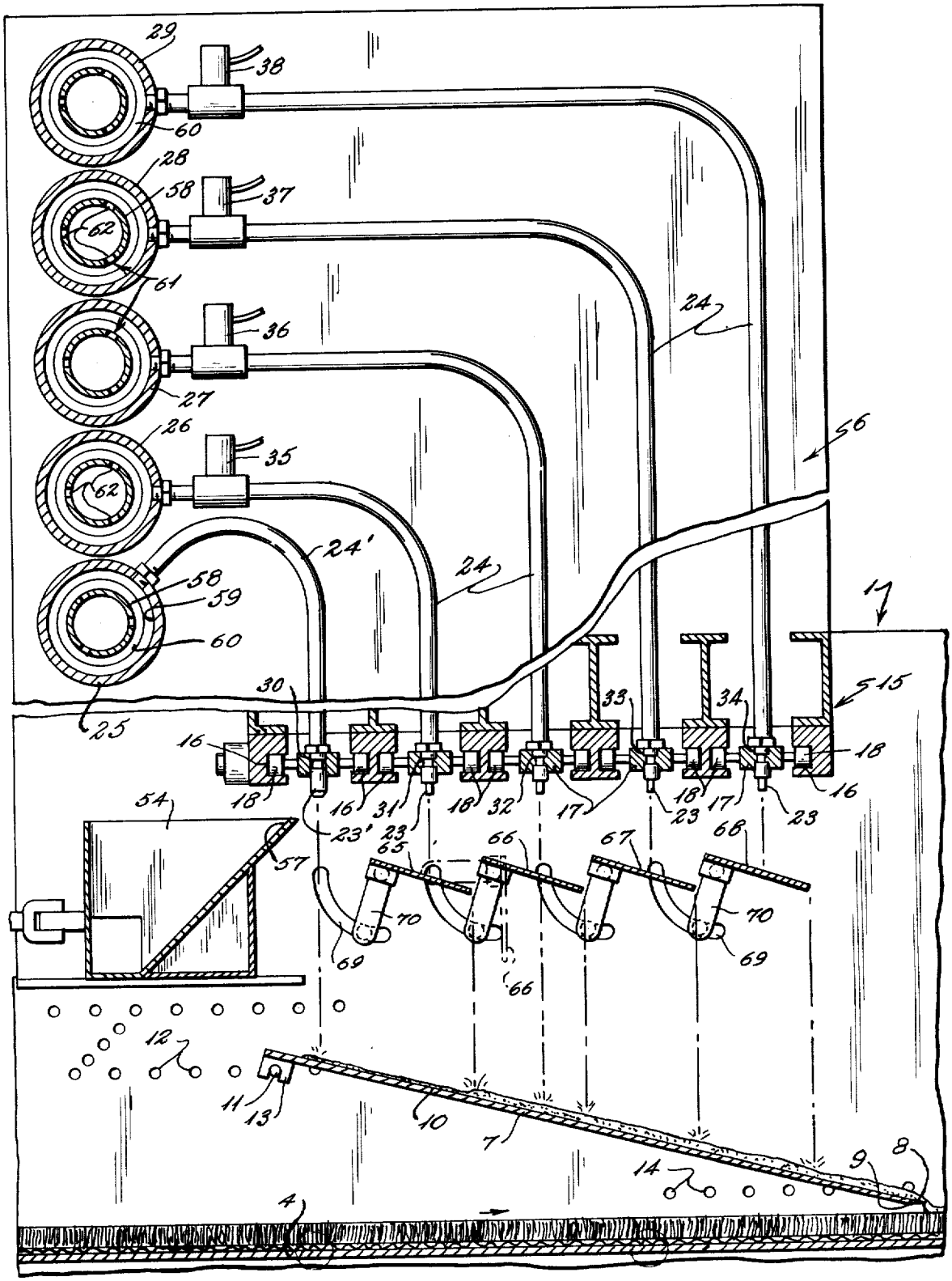
FIG. 4 is a section taken on the line 4—4, on an enlarged scale, of FIG. 3.
Figure 5:
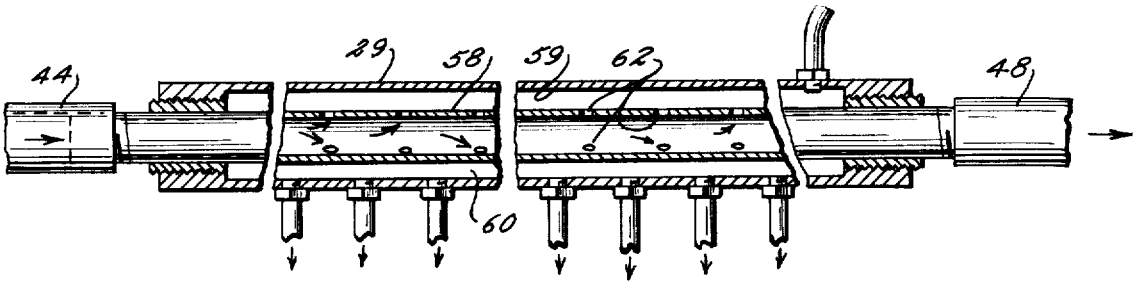
FIG. 5 is a section taken on the line 5—5 of FIG. 2 through one of the distributors according to the invention.

Each of the distributors 25 through 29 includes an internal duct 58 concentric with the outer wall 59 to form an annular chamber 60 serving the aperture row of that distributor. The ducts 58 each have a plurality of apertures 61 arranged in three rows 62, 63 and 64, which are positioned at 120° intervals about the periphery of the inner duct 58 and out of alignment with the apertures in the outer wall 59, preferably equidistantly, as best shown in FIG. 4. This configuration of the distributors is particularly advantageous in providing uniform, consistently reproducible flow rates through to the nozzles and in eliminating or dampening pulsations from the pump serving the distributor.

A plurality of spreader plates 65 through 68 are mounted above the plate 7 at positions in which they can be moved into a slanted position beneath a single one of the nozzle bars. The spreaders may be positionable by any convenient means such as the arcuate slots 69 and levers 70 shown in the drawings, and may be moved either manually or by an operator such as the cylinder 71 shown in FIG. 1. As shown in FIG. 4, all the spreaders are deployed for prespreading of the dyes of the nozzles served by the distributors 26 through 29 prior to delivery of the dye units onto the upper surface of the plate 7. It is to be understood, however, that the spreaders may be selectively deployed, as desired.

The system further includes a controller C for controlling the electromagnetic valves to produce timed or sequenced opening and closing of each of the valves of each of the distributors 25 through 29 to produce the desired pattern form. While a variety of controllers may be employed, a conventional drum type controller having pin contacts has been found suitable for the purpose. with simple connections therefrom to the individual valves such as exemplified by the wire 72 shown in FIG. 1.

In operation of the preferred embodiment, several adjustments are to be made to accommodate the particular materials to be used. It is important that the applicator edge 8 be both substantially perpendicular to the path of travel of the pile fabric and have a very close proximity thereto, in the order of from 1 mm to 3 mm from the upper surface of the fabric at the ends of the tufts forming the pile. In addition to the height adjustment, the plate 7 is adjusted in slope for the general viscosity of the dye coating material and the extent of lateral dispersion which is desired prior to delivery of the material onto the fabric. Generally, the slope of the plate 7 will be in the order of about 2° to 30° with respect to the horizontal, with the lower angles providing a slower progression of the material toward the edge 8 and a consequently increased opportunity for the materials to interdisperse before their delivery onto the fabric.

Figure 7:
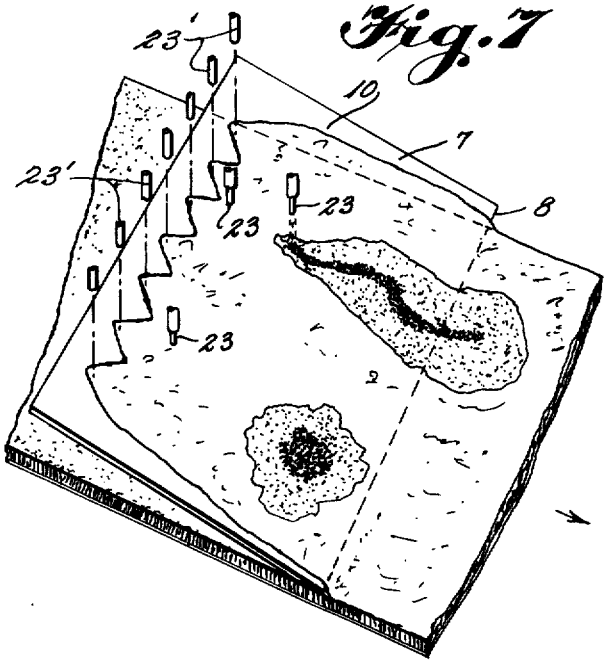
FIG. 7 is a schematic and isometric representation showing the composite sheet of interdispersed dye coatings being delivered onto a pile fabric.
Figure 9:
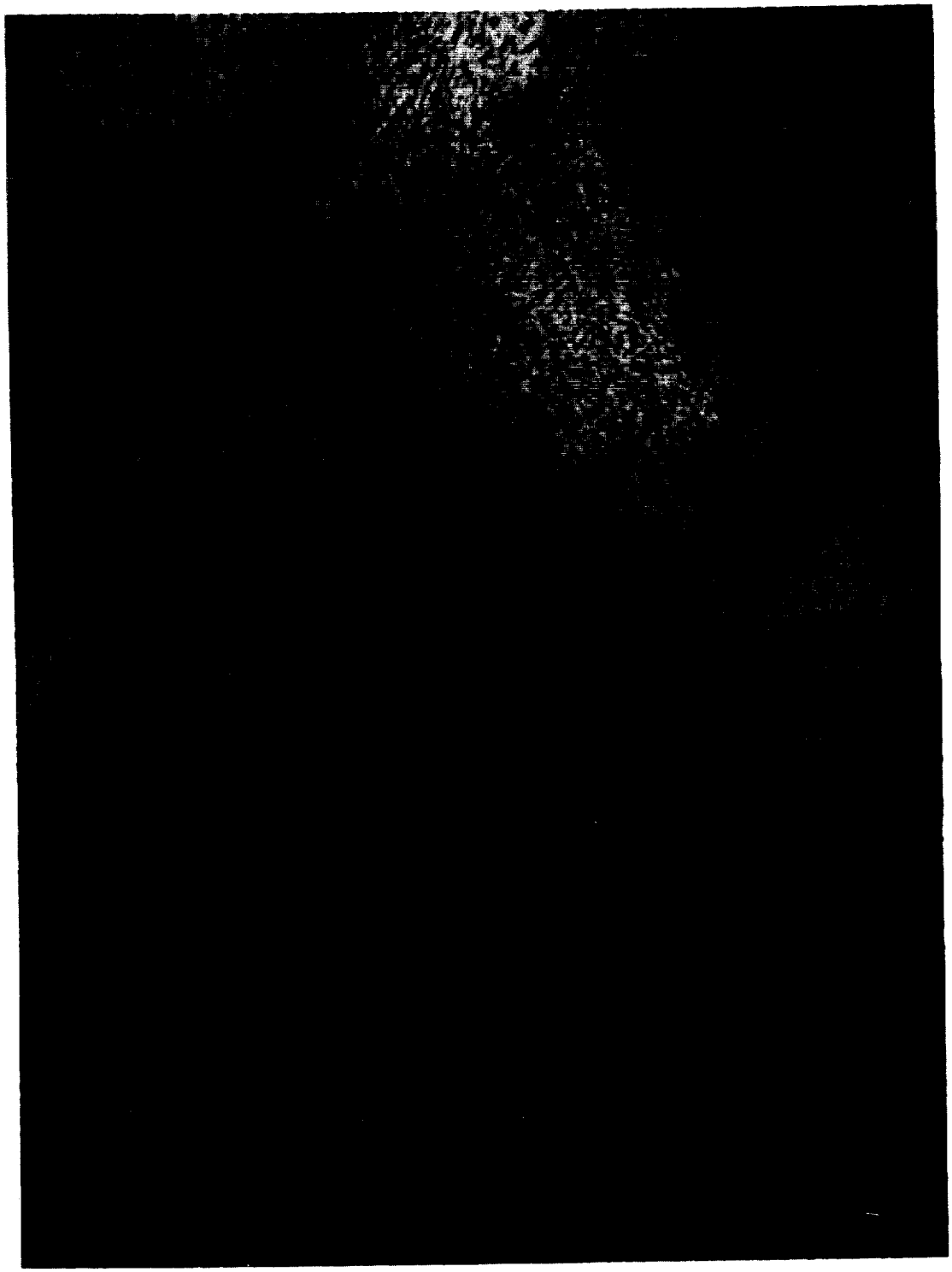
FIG. 9 is a photograph of an area of pile carpeting which was produced by an installation embodying the present invention and showing a variegated pattern of diffuse and interdispersed dyes which is achieved by the invention.

Typically, the dyes or coatings used in the system of the present invention will have a viscosity in the order of from as low as 1 to 20 cps and up to about 5000 cps, to permit direct penetration of the materials into the fabric as they are applied. It has been found that this preferred range affords a more uniform dyeing of the tufts with a lessened graduation of the color along the lengths of the tufts, thereby reducing the visual consequences of scuffs and reducing the noticeable changes in carpeting in heavy traffic wear areas. Referring to FIGS. 7 and 9 the variegated pattern of diffuse and interdispersed dyes is most readily illustrated. More specifically, FIG. 7 illustrates the depositing of dyes of different densities in various configurations that can be obtained in accordance with this invention.

Figure 8:
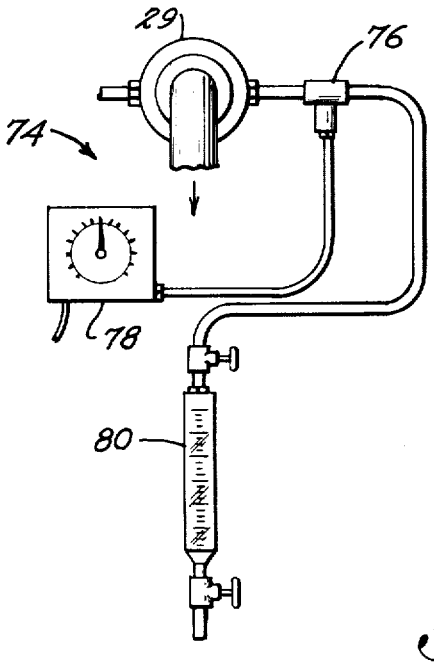
FIG. 8 is an end view of a modified form of distributor of the invention and schematically showing a flow-rate measuring system.

Referring to FIG. 8, for measuring flow rates of dyes and coating materials, a flow rate measuring apparatus 74 is provided in communication with a distributor 29, that connection establishing a fixed aperture (not shown) as is well known in the art of pipes and fluid connections. A valve 76 in the flow rate measuring apparatus is controlled by a timer 78 which cycles valve 76 "opened" and "closed" in order to permit fluid to flow through valve 76 for a period of time fixed by the timer 78. Valve 76 communicates with a volumetric measuring container 80 such as the burette shown. Thus, the amount of dye or coating which flows into the measuring container 80 during the cycle time established by the timer 78 varies in proportion to viscosity and pressure of the fluid at the distributor 29.

The fixed aperture establishes a flow rate for a fluid in accordance with the viscosity of the fluid and the pressure differential to which the fluid is subjected. Such an aperture may be separately installed between the distributor 29 and the measuring container 80 in a manner similar to the carburator jet in the fuel passage of an automotive carburator. Alternatively, the aperture may be established by the selection of the valve component 76, the fluid line connecting the valve 76 to the measuring container 80 and the dimensions of the inlet to the measuring container 80. The function of the container 80 is to determine the amount of fluid which passes through the valve 76, that valve being controlled by a timer which cycles the valve. Clearly, from the structure, a means for determining the amount of fluid to be discharged by the distributor at various pressures and fluid viscosities is provided.

The flow rate measuring apparatus 74 may therefore be used to enable the operator to repeat results which he was able to obtain with previous pressures and other operating parameters, even though fluid viscosity and specific gravity of the fluid used may be changed. The flow rate measuring apparatus 74, by permitting the operator to determine the amount of fluid discharged, permits him to adjust fluid pressure at the nozzles and, if necessary, to adjust the applicator plate 7 and the speed at which the fabric is advanced.

I claim:

1. Apparatus for producing diffused variegated patterns in pile fabrics comprising:

(a) an applicator member having
  (i) an applicator edge positionable parallel to and across a width of moving length of fabric, and
  (ii) a smooth upper surface inclined toward said applicator edge;

(b) means for delivering a first coating material onto said smooth upper surface to form a continuous sheet thereof flowing by gravity toward said applicator edge;

(c) a distribution means including
  (i) at least one array of nozzles positioned for delivery of at least one additional coating material onto the continuous sheet upstream of said applicator edge, said array of nozzles including at least one row of nozzles aligned transversely of the path of travel of the fabric,
  (ii) an elongate distributor member having a plurality of apertures therein,
  (iii) a plurality of conduits in individual communication between one of said distributor apertures and one of said nozzles, said conduits each including a flexible duct and a valve and
  (iv) delivery means for selectively delivering said additional coating material through selected nozzles of said array of nozzles to interdisperse with the continuous sheet of the first coating material while upon said smooth upper surface; and (d) a supporting bed for supporting a length of fabric in a substantially horizontal position to permit the length of fabric to move in a downstream direction and to permit the first and additional coating materials to penetrate into the fabric by force of gravity when the fabric is on the supporting bed.

2. Apparatus for producing diffused variegated patterns in fabrics comprising:

(a) an applicator member having an applicator edge positionable across the width of a length of fabric moving in a downstream direction, and a smooth upper surface on said applicator member and inclined toward said applicator edge;

(b) means for delivering a first coating material onto said smooth upper surface to form a continuous sheet thereof flowing by gravity toward said applicator edge;

(c) a distribution means comprised of:
  (i) at least one array of nozzles positioned for delivery of at least one additional coating material onto the continuous sheet upstream of said applicator edge, said array of nozzles including at least one row of nozzles aligned transversely of the path of travel of the fabric;
  (ii) an elongate distributor member having a plurality of apertures therein,
  (iii) a plurality of conduits, each conduit in individual communication between one of said distributor apertures and one of said nozzles, and the conduits including a flexible duct and a valve and
  (iv) delivery means for selectively delivering said additional coating material through selected nozzles of said array of nozzles to interdisperse with the continuous sheet of coating material while on said smooth upper surface; and (d) means for supporting the fabric to permit the coating materials flowing over the applicator edge to penetrate the fabric by force of gravity.

3. The apparatus of claims 1 or 2 in which said applicator member is positionable at differing positions with regard to said nozzle array along the path of travel of the fabric.

4. The apparatus of claim 3 in which said smooth upper surface is adjustable in its incline toward said applicator edge.

5. The apparatus of claim 4 including means for reciprocating at least a portion of said nozzle array transversely with regard to the path of travel of the fabric.

6. The apparatus of claim 1 including at least one spreader surface positionable intermediate a portion of the nozzle array and said smooth upper surface to partially spread a portion of said one additional coating material prior to its delivery onto said continuous sheet of first coating material.

7. The apparatus of claims 1 or 2 in which said flexible ducts are of equal length and of sufficiently low flow area to comprise flow-stabilizing resistance lines, whereby dripping of material at said nozzles is precluded when said valve in said conduit is closed.

8. Apparatus for producing diffused variegated patterns in fabrics comprising:

(a) an applicator member having an applicator edge positionable across the width of a length of fabric moving in a downstream direction, and a smooth upper surface on said applicator member and inclined toward said applicator edge;

(b) means for delivering a first coating material onto said upper applicator surface to form a continuous sheet thereof flowing by gravity toward said applicator edge;

(c) a distribution means comprised of:
  (i) at least one array of nozzles positioned for delivery of at least one additional coating material onto the continuous sheet upstream of said applicator edge;
  (ii) said array of nozzles including at least one row of nozzles aligned transversely of the path of travel of the fabric;
  (iii) an elongate distributor member having a plurality of apertures therein, concentric inner and outer pipes forming an annular chamber communicating with said apertures, said apertures being aligned in a row along said outer pipe, said inner pipe including a plurality of groups of three apertures positioned equidistantly from each other about the circumference of said inner pipe, and said apertures in said outer pipe being arcuately intermediate and equidistant from adjacent of said group apertures;
  (iv) a plurality of conduits, each conduit in individual communication between one of said distributor apertures and one of said nozzles, and said conduits including a flexible duct and a valve; and
  (v) delivery means for selectively delivering said additional coating material through selected nozzles of said array of nozzles to interdisperse with the continuous sheet material while on said upper applicator surface.

* * * * *